United States Patent [19]

Pfaler

[11] 4,181,568

[45] Jan. 1, 1980

[54] HEADBOX FOR A PAPER MACHINE FOR THE PRODUCTION OF A FIBER WEB OF AT LEAST TWO PLIES

[75] Inventor: Johan v. Pfaler, Nokia, Finland

[73] Assignee: Oy Tampella AB, Tampere, Finland

[21] Appl. No.: 911,012

[22] Filed: May 30, 1978

[30] Foreign Application Priority Data

Jul. 13, 1977 [FI] Finland ..... 772184

[51] Int. Cl.[2] ..... D21F 1/02; D21F 1/06

[52] U.S. Cl. ..... 162/343; 162/301; 162/347

[58] Field of Search ..... 162/347, 343, 301, 216, 162/203, 132, 346

[56] References Cited

U.S. PATENT DOCUMENTS

| | | | |
|---|---|---|---|
| 3,823,062 | 7/1974 | Ward et al. | 162/343 X |
| 3,853,697 | 12/1974 | Parker et al. | 162/347 X |
| 3,923,593 | 12/1975 | Verseput | 162/343 X |
| 4,081,321 | 3/1978 | Wolf et al. | 162/346 |

*Primary Examiner*—Richard V. Fisher

*Attorney, Agent, or Firm*—Ladas, Parry, Von Gehr, Goldsmith & Deschamps

[57] ABSTRACT

A headbox for a paper machine for manufacturing at least a two-ply fiber web, comprising separate slice channels each connected to a separate source of fiber suspension and forming a slice opening extending across the wires of the paper machine for supplying separate fiber suspension streams upon the wires. The slice chambers are separated from each other by means of division walls each supported at the upstream end by the headbox adjustably in the cross direction with respect to the flow direction of the fiber suspension in the slice channel in order to allow adjustment of the cross sectional areas of said slice channels at the upstream ends of the division walls.

14 Claims, 10 Drawing Figures

FIG. 5
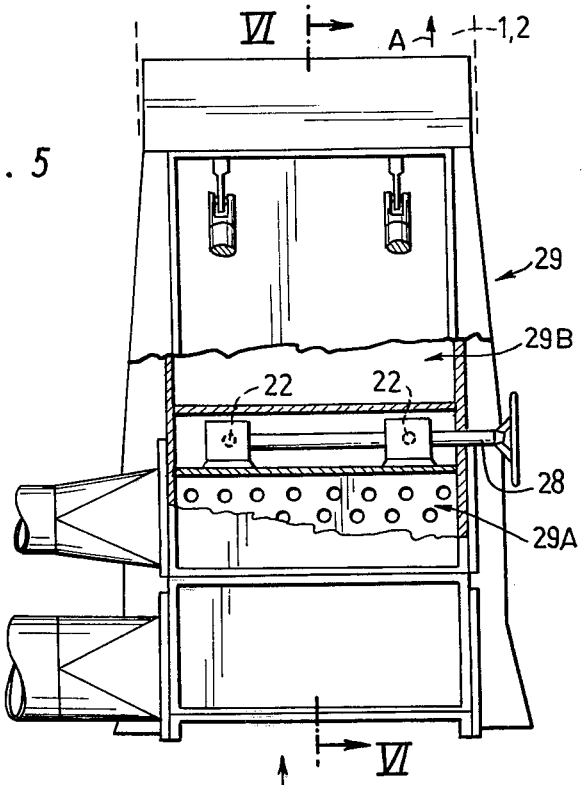
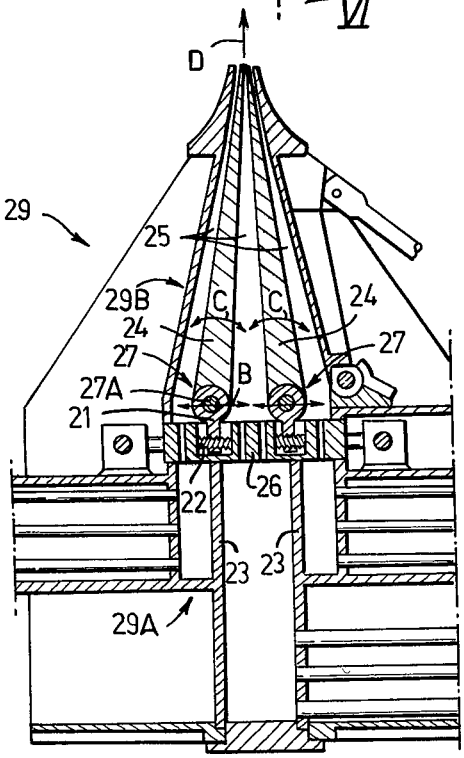
FIG. 6

HEADBOX FOR A PAPER MACHINE FOR THE PRODUCTION OF A FIBER WEB OF AT LEAST TWO PLIES

This invention relates to a headbox for a paper machine for the production of a two- or multi-ply fiber web, which headbox forms a slice opening extending across the wires of the paper machine, and is divided by means of at least one wall into separate slice channels which are connected to separate sources of fiber suspensions for supplying separate fiber suspensions in streams with the width of wire upon the wires, and the upstream end of the division wall is joined to the headbox. This kind of headbox is used in the production of multi-ply webs, especially paper webs by means of one headbox by bringing separate streams of fiber suspensions one upon the other between two wires.

In the prepublished Finnish patent application No. 3206/73 (equivalent to U.S. Pat. No. 3,823,062) a headbox is disclosed in which each of the division walls consists of a rigid plate, the upstream end of which is pivotably mounted to the inlet of the headbox by means of a joint stationarily arranged in the inlet. Thus the division walls form separate slice channels which supply the different fiber suspensions as separate streams to the slice opening of a slice chamber forming an extension of the inlet.

This kind of headbox is usually designed for certain volume flows of fiber suspensions passing through the individual slice channels per time unit. If a deviation from these initial operating characteristics takes place, for example due to a change in the basis weight or consistency etc., a pressure difference over the division wall or walls is caused, which tends to move the walls from their original positions. Because the upstream ends of the walls are fastened to the inlet by means of stationary joints and because only the downstream ends of the walls at the slice opening can thus move in relation to each other and to the walls of the slice chamber, speed differences arise in the slice opening between the different suspension streams flowing out from the slice channels respectively. These speed differences make the fiber streams mix with each other and thus break the desired structure of the web.

In the prepublished Finnish patent application No. 3796/74 (equivalent to U.S. Pat. No. 3,923,593) a headbox is disclosed which consists of two parts; an inlet and a slice chamber forming an extension of the inlet. The inlet is divided into separate channels by means of stationary, rigid partitions, while the slice chamber is divided into separate slice channels by means of flexible walls forming extensions of the stationary partitions. Also in this construction the upstream ends of the walls in the slice chamber are stationary, but otherwise the walls can float freely in the slice chamber.

When a deviation from the initial operation data takes place in this headbox, the pressure differences are not balanced over the stationary partitions, but the balancing takes place in the slice chamber over the flexible walls. If the deviation from the initial operating characteristics is big, the walls must bend severely, which reduces the stability of the suspensions streams flowing through the slice channels separated by the walls. The ends of the walls facing the slice opening tend to move from the desired position and thus mix the layers of the stock jet.

The object of this invention is to obtain a headbox which can be used with varied rates of volume flow without causing the disadvantages described above. According to the invention this object is reached with a headbox characterized in that the joint for each division wall is adjustable across the flow direction of the fiber suspensions and in that the headbox is equipped with adjusting means for displacing said joint.

In the headbox according to the invention it is possible to displace the joint of each wall in a direction perpendicular to the direction of the flow of the fiber suspensions and substantially perpendicular to the plane of the wires so that the ratio of the cross sectional areas of the different slice channels at the level of the joint of the walls is the same as the ratio of the stock volumes flowing through respective slice channels per time unit. Thus it is always possible to displace the joint of the wall to a point in the headbox which is theoretically correct in view of the relation between the desired volumes of the stocks per time unit. Thus no pressure differences arise over the division walls, that would tend to force the division walls away from the positions which cause equal speed to the stock streams flowing out from the slice opening.

In the following the invention will be more closely described with reference to the attached drawings, in which FIG. 1 is a diagrammatic illustration of a paper machine equipped with a headbox according to the present invention.

FIG. 5 is a side view of a second embodiment of the headbox partly sectioned.

FIG. 6 is a sectional view of the headbox along line VI—VI in FIG. 5.

Figure 1:
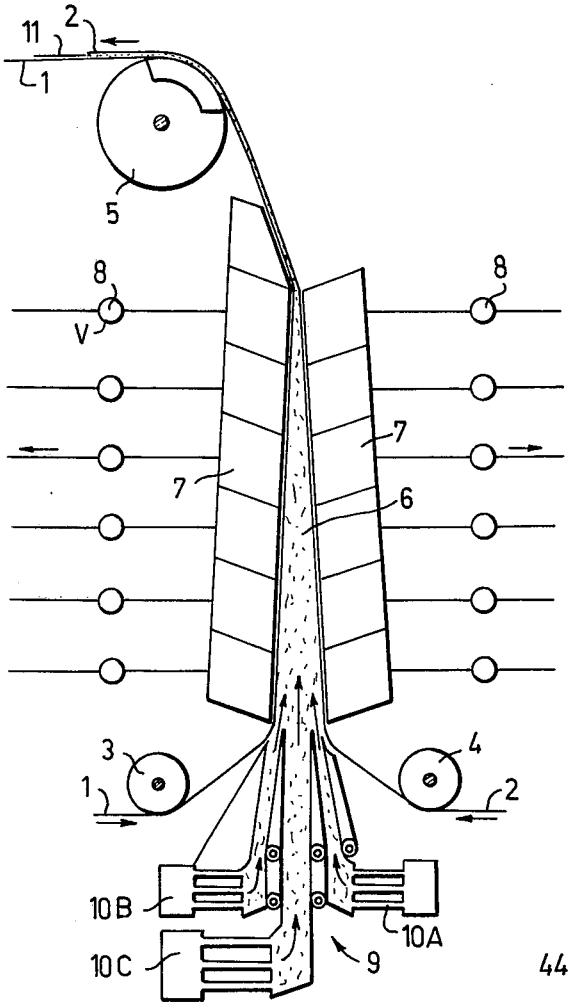

In FIG. 1 two forming wires 1 and 2 are passed over rolls 3,4,5 to form an evenly converging forming zone 6. In the forming zone, on the outer sides of the wires, dewatering boxes 7 are provided. The dewatering is caused by pressure difference over the wire and it is controlled by individually adjustable throttle valves 8. At the beginning of the forming zone 6 a headbox 9 is provided which is equipped with several, in this case three, manifolds 10A, 10B, 10C to supply separate fiber suspensions into the headbox. The separate fiber suspensions flow from the headbox between the wires 1,2 and further through the forming zone 6 in which the fiber suspension is dewatered. The sheet 11 thus formed runs between the wires over the carrying roll 5 and, supported by the wire 1, in a known manner further to the press section. The wires 1 and 2 are returned back to the rolls 3,4 by stretcher, carrying and guide rolls.

Figure 2:
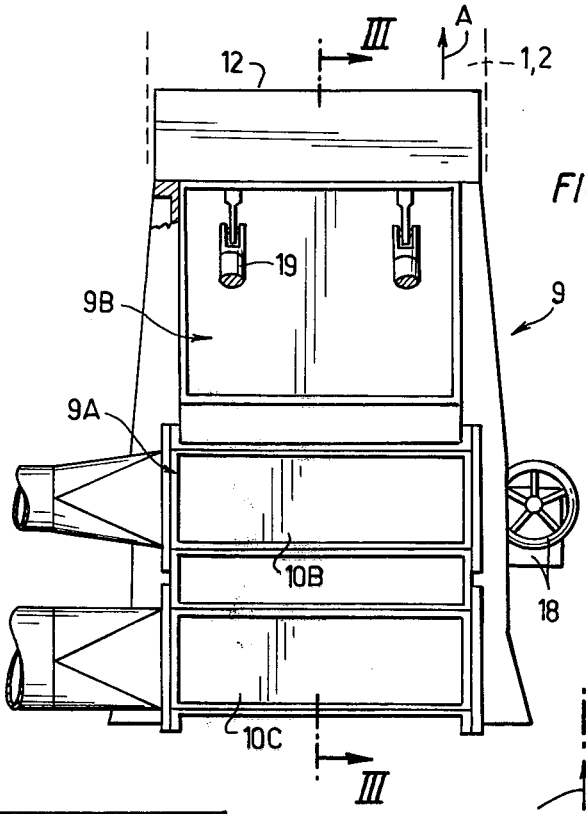
FIG. 2 is an enlarged side view of the headbox.
Figure 4:
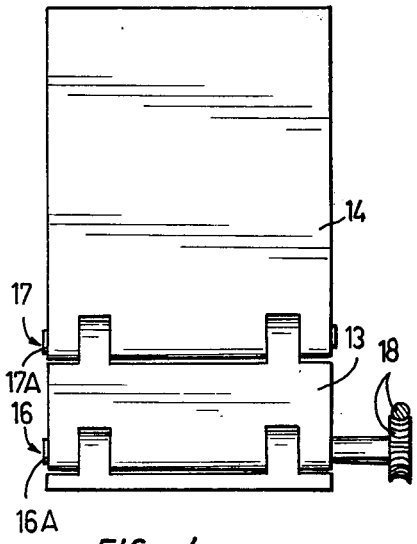
FIG. 4 is a sectional view of the headbox along line IV—IV in FIG. 3.
Figure 3:
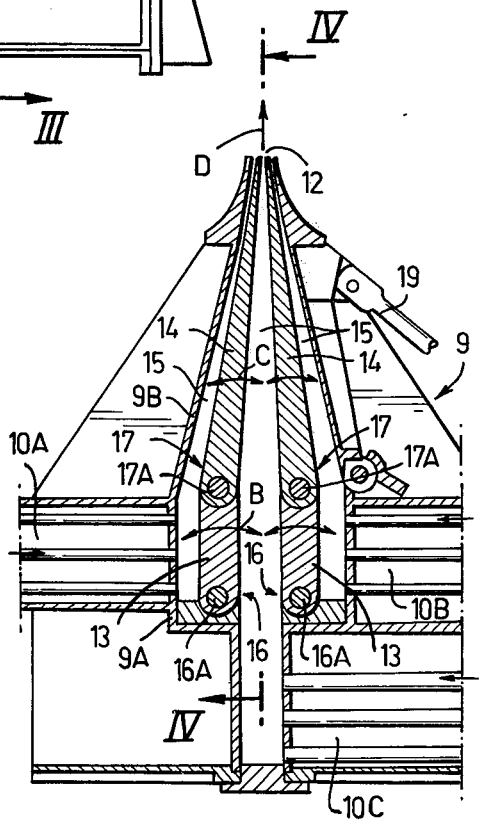
FIG. 3 is a sectional view of the headbox along line III—III in FIG. 2.

In FIGS. 2 and 3 the headbox 9 comprises an inlet 9A and a narrowing slice chamber 9B connected thereto, which slice chamber ends in a narrow slice opening 12. The slice opening is located crosswise in relation to the movement direction A of the wires 1,2 and is substantially as wide as the wires. The inlet and the slice chamber are divided by means of two partitions 13 and two walls 14 respectively in three separate slice channels 15. The said manifolds 10A, 10B, 10C thus end in their respective slice channels as shown in FIG. 3. Each platelike partition 13 is pivotably mounted to the inlet 9A by means of a joint 16, which is stationary positioned in the upstream end of the inlet. The pivot shaft 16A of the joint 16 is parallel to the slice opening 12 so that the partition can turn around the joint 16 as shown by the arrow B. Each division wall 14 is pivotably mounted to the respective partition 13 by means of a joint 17, the pivot shaft 17A of which is parallel to the above-mentioned joint 16 and slice opening 12. Thus the wall can turn in the slice chamber 9B around its joint 17 as shown by the arrow C. The headbox is equipped with adjusting means 18, which is coupled to the shaft 16A of one of the partitions 13 in order to turn said shaft and the partition supported by said shaft. The other partition 13 is provided with corresponding adjusting means. The adjusting means consists, for example, of a worm gear equipped with a hand wheel, as illustrated in FIGS. 2 and 4.

The size of the slice opening 12 of the slice chamber can be controlled by adjustment means 19.

The different fiber suspensions are pumped into the manifolds 10A–10C of the headbox, whereby each fiber suspension is evenly divided over the whole width of the machine. From the manifolds the fiber suspensions flow into the slice channels 15 of the inlet 9A and possible lumps of fibers are broken by shear forces occuring in the slice channels so that the stock is homogenized. From the inlet the fiber suspensions flow in separate streams through the slice chamber into the slice opening 12 and further, carried by the wires 1,2, through the forming zone 6 in order to form a multi-ply sheet 11.

If the volume of one fiber suspension fed per time unit is changed the pressures of the streams in the slice channels 15 and correspondingly also the flow speeds change. In order to equalize the flow speeds and pressures at a certain point in the slice channels the position of the joints 17 at the upstream ends of the division walls 14 is changed in a direction perpendicular to the flow direction D of the fiber suspensions i.e. in the thickness direction of the fiber suspension stream, so that the mutual relation of the flow volumes per time unit is the same as the mutual relation of the cross sectional areas of the slice channels 15 at the level of the joints 17. If the locations of the joints 17 are adjusted in the above mentioned way the cross sectional areas of the slice channels adjust themselves automatically due to the inner pressures of the fiber suspension streams. This is possible because the division walls 14, which are freely pivotable, can adjust themselves in accordance with the relation between the flow volumes in the individual slice channels.

FIGS. 5 and 6 show an embodiment in which the partitions 23 in the inlet 29A of the headbox 29 are stationary. Also here the walls 24 defining the slice channels 25 are fastened by joints 27, which are positioned substantially on the extensions of the partitions, at the level between the inlet 29A and the slice chamber 29B.

The shafts 27 of the joints of the walls are fastened to supports 21 which are supported by two screws 22 arranged at a distance from each other. The screws are positioned at right angles to the flow direction D of the fiber suspensions and the shaft 27A. The screws are rotatably supported by a hole plate 26 and coupled to adjusting elements 28 for rotating the screws. The screws are further coupled to supports 21 so that the joints 27 of the division walls can be displaced in the direction of the screws as indicated by the arrows B in order to make the slice channels broader or narrower. The division walls can freely pivot in the slice chamber around their joints 27 as indicated by the arrows C.

Figure 7:
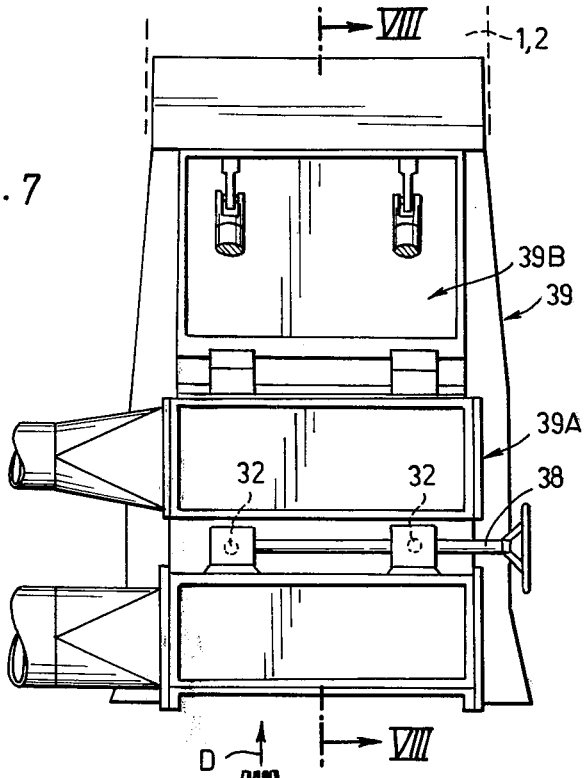
FIG. 7 is a side view of a third embodiment of the headbox.
Figure 8:
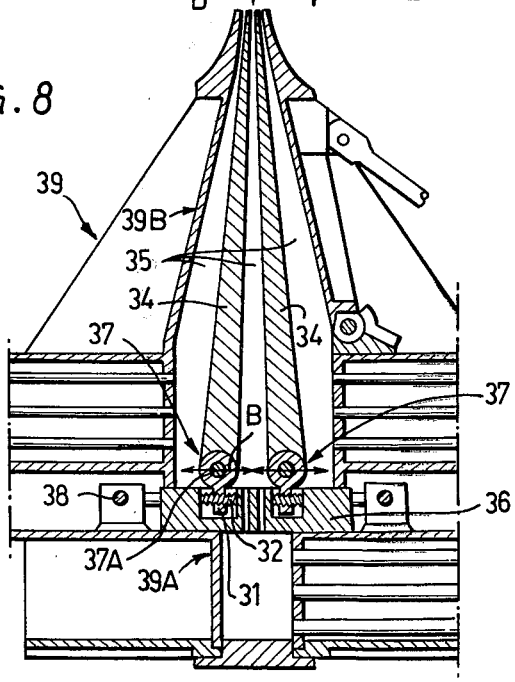
FIG. 8 is a sectional view of the headbox along line VIII—VIII in FIG. 7.

FIGS. 7 and 8 show an embodiment in which the joints 37 of the division walls 34 are located in the upstream section of the inlet 39A of the headbox 39. The construction of the joints and the adjusting means are the same as shown in FIGS. 5 and 6; therefore the corresponding components are also referred to by the same reference numbers, raised with 10.

Figure 9:
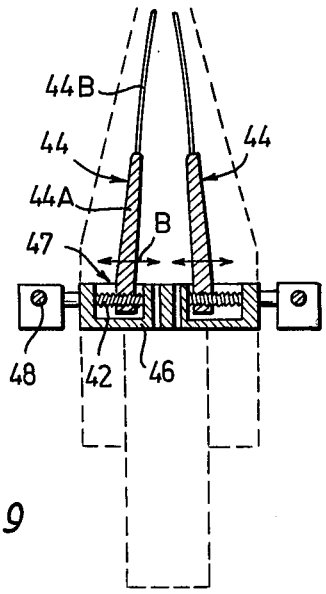
FIG. 9 is still another embodiment of the wall construction of the headbox.

FIG. 9 illustrates an embodiment of the invention in which the joints 47 of the division walls 44 are rigid. The walls are rigidly supported by screws 42 which are rotatably mounted in a hole plate 46 and are positioned at right angles to the surface of the walls. The screws are in thread engagement with the walls and are rotatable by adjusting means 48 and serve thus as guide bars for the walls. The walls can be displaced on these guide bars at right angles to the flow direction D of the fiber suspensions.

The joint construction according to FIG. 9 is applicable both in a headbox in which the joints of the walls are located at the level between the inlet and the slice chamber (headbox 29 in FIG. 6), and in a headbox, in which the joints of the walls are located in the upstream section of the inlet (headbox 39 in FIG. 8).

In the embodiment according to FIG. 9 the division wall 44 consists of two parts; a rigid plate 44A at the upstream and a flexible extension 44B attached at one end rigidly to the downstream end of the plate 44A.

Figure 10:
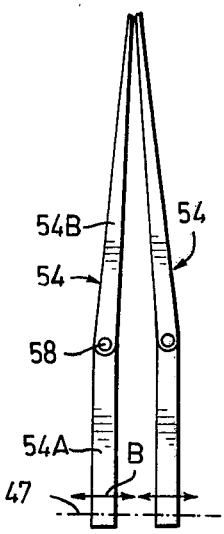
FIG. 10 is a sectional view of a modified wall construction.

Each of the two parts of the division wall 54 (FIG. 10) can also consist of rigid plates 54A, 54B which are articulated to each other by means of a joint 58.

The purpose of the drawings and the specification is only to illustrate the idea of the invention. In details the headbox according to the invention can vary considerably within the scope of the claims. Thus the constructions according to the presented embodiments can be combined in different ways.

What I claim is:

1. A headbox for a paper machine for the production of a fiber web having at least two plies, which headbox defines a slice chamber, at least first and second inlet means for admitting respective fiber suspensions to the slice chamber, and an elongated slice opening which, in use, extends across a wire of the paper machine, the headbox being provided with at least one division wall which is substantially platelike and is disposed within the slice chamber substantially parallel to the longitudinal direction of said slice opening to divide the slice chamber into at least first and second separate slice channels through which the respective fiber suspensions admitted by the first and second inlet means pass to the slice opening as streams of width substantially equal to that of the wire and leave the slice chamber to form on the wire a web of at least two plies formed respectively by the fiber suspensions admitted by the first and second inlet means, and the headbox further being provided with a support member mounted at the upstream end of the slice chamber so as to be movable in a direction substantially perpendicular both to the direction of flow of fiber suspensions in the slice channels and to the longitudinal direction of the slice opening, pivotal means connecting the upstream end of the division wall to the support member, and adjusting means connected to the support member to bring about movement of the support member and thereby to bring about movement of the upstream end of the division wall.

2. A headbox as claimed in claim 1, which defines an inlet chamber upstream of the slice chamber and into which the inlet means open, and wherein the support member comprises a partition which divides the inlet chamber into first and second inlet channels which communicate with the first and second slice channels respectively, the first inlet means opening into the first inlet channel and the second inlet means opening into the second inlet channel, and the division wall forming substantially an extension of said partition, and wherein the pivotal means include a first pivot shaft which extends perpendicular to the direction of flow of fiber suspensions in the slice channels and parallel with the longitudinal direction of the slice opening and defines a first axis of pivotal movement of the division wall with respect to the partition, and wherein the headbox is further provided with a second pivot shaft mounted at the upstream end of the inlet chamber and extending parallel to the first shaft and the partition has an upstream end which is mounted on said second shaft for pivotal movement of the partition in the inlet chamber about a second axis of pivotal movement, defined by said second pivot shaft.

3. A headbox as claimed in claim 2, wherein said partition is secured to said second shaft and said second shaft is connected to said adjusting means for rotating said second shaft and said partition about said second pivotal axis.

4. A headbox as claimed in claim 1, wherein said pivotal means comprise a shaft which extends perpendicular to the direction of flow of fiber suspensions in the slice channels and parallel to the longitudinal direction of the slice opening and defines an axis of pivotal movement of the division wall relative to the support member.

5. A headbox as claimed in claim 4, defining an inlet chamber into which said inlet means open, and being provided with a stationary partition which divides the inlet chamber into first and second inlet channels which communicate with the first and second slice channels respectively, the first inlet means opening into the first inlet channel and the second inlet means opening into the second inlet channel, and wherein said support member is mounted at the downstream end of said stationary partition.

6. A headbox as claimed in claim 4, defining an inlet chamber into which the inlet means open, said support member being at the upstream end of the inlet chamber whereby the division wall divides the inlet chamber into first and second inlet channels which communicate with the first and second slice channels respectively, the first inlet means opening into the first inlet chamber and the second inlet means opening into the second inlet chamber.

7. A headbox as claimed in claim 4, 5 or 6, wherein said support member is mounted upon and threadedly engaged with at least one threaded member, the central axis of which is perpendicular to said pivotal axis, and wherein said adjusting means comprise means for rotating said threaded member to displace said support member along said threaded member.

8. A headbox for a paper machine for the production of a fiber web having at least two plies, which headbox defines a slice chamber, at least first and second inlet means for admitting respective fiber suspensions to the slice chamber, and an elongated slice opening which, in use, extends across a wire of the paper machine, the headbox being provided with at least one division wall which is substantially platelike and is disposed with the slice chamber substantially parallel to the longitudinal direction of said slice opening to divide the slice chamber into at least first and second separate slice channels through which the respective fiber suspensions admitted by the first and second inlet means pass to the slice opening as streams of width substantially equal to that of the wire and leave the slice chamber to form on the wire a web of at least two plies formed respectively by the fiber suspensions admitted by the first and second inlet means, and the headbox further being provided with a support member mounted at the upstream end of the slice chamber, and wherein said division wall comprises a downstream part and an upstream part to which the downstream part is connected and which is secured to said support member in such manner as to permit displacement of said upstream part in a direction substantially perpendicular both to the direction of flow of fiber suspensions in the slice channels and to the longitudinal direction of the slice opening while preventing pivotal movement of the upstream part within the headbox, and the headbox further being provided with adjusting means connected to the support member to bring about such displacement of the upstream part of the division wall.

9. A headbox as claimed in claim 8, wherein said support member comprises a guide rod which is supported by the headbox and is positioned perpendicular to the upstream part of the division wall.

10. A headbox as claimed in claim 9, wherein the guide rod is a threaded member which is threadedly engaged with the upstream part of the division wall, and wherein said adjusting means comprise means for rotating said threaded member to displace said upstream part.

11. A headbox as claimed in claim 10, defining an inlet chamber into which the inlet means open, and being provided with a stationary partition which divides the inlet chamber into first and second inlet channels which communicate with the first and second slice channels respectively, the first inlet means opening into the first inlet channel and the second inlet means opening into the second inlet channel, and wherein the guide rod is positioned at the downstream end of the stationary partition.

12. A headbox as claimed in claim 10, defining an inlet chamber into which said inlet means open, said guide rod being at the upstream end of the inlet chamber whereby the inlet chamber is divided by the division wall into first and second inlet channels which communicate with the first and second slice channels respectively, the first inlet means opening onto the first inlet channel and the second inlet means opening into the second inlet channel.

13. A headbox as claimed in claim 8, wherein the upstream part of the division wall is rigid and the downstream part is flexible, the downstream part being secured to the upstream part in a manner preventing pivotal movement of the downstream part relative to the upstream part.

14. A headbox as claimed in claim 8, wherein the downstream part of the division wall is rigid and the upstream part of the division wall is rigid, the upstream and downstream parts being joined together in a manner permitting pivotal movement of the downstream part relative to the upstream part.

* * * * *